United States Patent [19]

Leslie

[11] 4,446,042

[45] May 1, 1984

[54] BRIGHTENER FOR DETERGENTS CONTAINING NONIONIC AND CATIONIC SURFACTANTS

[75] Inventor: Kenneth A. Leslie, Cincinnati, Ohio

[73] Assignee: The Procter & Gamble Company, Cincinnati, Ohio

[21] Appl. No.: 434,765

[22] Filed: Oct. 18, 1982

[51] Int. Cl.[3] ..... C11D 1/835; C11D 3/42; C11D 17/08

[52] U.S. Cl. ..... 252/102; 252/8.75; 252/8.8; 252/98; 252/301.21; 252/524; 252/528; 252/543; 252/547; 252/DIG. 14

[58] Field of Search ..... 252/8.8, 8.75, 543, 252/DIG. 1, 301.21, 547, 528, 527, 98, 524, DIG. 14

[56] References Cited

U.S. PATENT DOCUMENTS

| | | | |
|---|---|---|---|
| 2,742,434 | 4/1956 | Kopp | 252/524 |
| 3,351,557 | 11/1967 | Almstead et al. | 252/106 |
| 3,537,993 | 11/1970 | Coward et al. | 252/8.75 |
| 3,704,228 | 11/1972 | Eckert et al. | 252/98 |
| 3,721,633 | 3/1973 | Ranauto | 252/527 |
| 3,781,204 | 12/1973 | Katsumi et al. | 252/8.75 |
| 3,896,034 | 7/1975 | Eckert et al. | 252/547 |
| 4,102,825 | 7/1978 | Murata et al. | 252/547 |
| 4,140,641 | 2/1979 | Ramachandran | 252/8.75 |
| 4,222,905 | 9/1980 | Cockrell | 252/547 |
| 4,233,167 | 11/1980 | Sramck | 252/8.75 |
| 4,259,217 | 3/1981 | Murphy | 252/547 |
| 4,294,711 | 10/1981 | Hardy et al. | 252/8.75 |

FOREIGN PATENT DOCUMENTS 1597132 7/1970 France .

OTHER PUBLICATIONS

Pending U.S. Pat. Appl. Ser. No. 376,877, Cook et al., filed May 10, 1982.

Pending U.S. Pat. Appl. Ser. No. 398,035, Hughes, filed Jul. 14, 1982.

Pending U.S. Pat. Appl. Ser. No. 371,691, Llenado, filed Apr. 26, 1982.

*Primary Examiner*—John E. Kittle
*Assistant Examiner*—Mukund J. Shah
*Attorney, Agent, or Firm*—Donald E. Hasse; Robert B. Aylor; Thomas H. O'Flaherty

[57] ABSTRACT

Described are laundry detergent compositions containing nonionic surfactants, cationic surfactants and compatible anionic brighteners which are highly effective at whitening cotton fabrics.

10 Claims, No Drawings

BRIGHTENER FOR DETERGENTS CONTAINING NONIONIC AND CATIONIC SURFACTANTS

TECHNICAL FIELD

The present invention relates to laundry detergent compositions containing nonionic surfactants, quaternary ammonium cationic surfactants, and selected anionic brighteners which are especially effective at whitening and maintaining the whiteness of cotton fabrics. The compositions herein also provide excellent removal of particulate and greasy/oily soils, as well as fabric softening, static control, color fidelity (i.e., inhibition of the bleeding of fabric colors into the laundry solution), and dye transfer inhibition (i.e., the inhibition of the redeposition of dyes in the laundry solution onto fabrics) benefits, even in the total absence of detergency builder materials. Other detergent compositions which utilize mixtures of selected nonionic and cationic surfactants are disclosed in U.S. Pat. No. 4,222,905, Cockrell, issued Sept. 16, 1980; and in U.S. Pat. No. 4,259,217, Murphy, issued Mar. 31, 1981; both incorporated herein by reference.

BACKGROUND ART

The use of optical brighteners, also known as fluorescent whitening agents, in laundry detergents is desirable from an overall performance standpoint. Brighteners deposit onto fabric surfaces where they absorb ultraviolet radiant energy, such as that found in ordinary daylight, and reemit the energy as a blue light which reduces or eliminates any yellow cast to fabrics and gives them a brighter appearance.

The selection of suitable brighteners for detergents containing nonionic and cationic surfactants presents a special problem since many conventional brighteners are anionic in nature and tend to form insoluble complexes with the cationic surfactants, thereby decreasing the effectiveness of both brightener and surfactant. This problem has been recognized in the art and a number of potential solutions to it have been suggested. For example, U.S. Pat. No. 2,742,434, Kopp, issued Apr. 17, 1956, U.S. Pat. No. 3,904,533, Neiditch et al, issued Sept. 9, 1975, and Japanese laid-open publication No. 43708/78, Kao Soap Company, published Apr. 20, 1978, teach the use of specifically selected anionic brighteners for use in cationic surfactant-containing detergent compositions. Further, certain types of nonionic and cationic brighteners have been suggested in U.S. Pat. No. 3,704,228, Eckert et al, issued Nov. 28, 1972, U.S. Pat. No. 3,896,034, Eckert et al, issued July 22, 1975, and South African Application No. 65/5106, General Foods Corporation, published March, 1966. While many of these brighteners are compatible with certain types of cationic surfactants, their usage over time tends to discolor fabrics, generally with a greenish/yellow tinge, making them impractical for use in commercial laundry detergent compositions. Cationic brighteners in particular tend to deposit onto soils and cause greenish/yellow tinting of fabrics. In addition, some nonionic brighteners are not suitable because they tend to bioaccumulate in the environment.

It has now been found that by selecting the specific anionic brighteners herein for use in cationic/nonionic detergent compositions, excellent brightening performance is achieved, particularly on cotton fabrics, without any concomitant discoloration problems. While not intending to be limited by theory, it is believed that the anionic brighteners herein are highly effective because they are extremely soluble in the present nonionic/cationic surfactant systems and do not readily form insoluble complexes with the cationic surfactants.

SUMMARY OF THE INVENTION

The present invention relates to laundry detergent compositions comprising:

(a) from about 5% to about 95% of a surfactant mixture consisting essentially of:

(i) an ethoxylated alcohol or ethoxylated alkyl phenol nonionic surfactant of the formula $R(OC_2H_4)_nOH$, wherein R is an aliphatic hydrocarbon radical containing from about 10 to about 18 carbon atoms or an alkyl phenyl radical in which the alkyl group contains from about 8 to about 15 carbon atoms, and n is from about 2 to about 9, said nonionic surfactant having an HLB of from about 5 to about 14; and (ii) a quaternary ammonium cationic surfactant having 2 chains which each contain an average of from about 12 to about 22 carbon atoms;

the weight ratio of said nonionic surfactant to said cationic surfactant being from about 2:1 to about 40:1; and (b) from about 0.01% to about 3% by weight of an anionic brightener of the formula

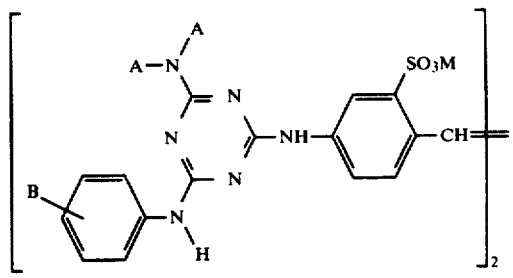

wherein each A is hydrogen, methyl, ethyl, isopropyl, 2-hydroxyethyl, 2-hydroxypropyl, or propanamido, or taken together are morpholino or anilino; and each B is hydrogen or $—SO_3M$, wherein M is a compatible cation and the total number of $—SO_3M$ groups in the molecule is from 3 to 6 with no more than 2 $—SO_3M$ groups per anilino group;

the equivalent weight ratio of said cationic surfactant to said brightener being greater than about 3.

DETAILED DESCRIPTION OF THE INVENTION

The compositions of the present invention comprise from about 5% to about 95%, preferably from about 7% to about 50%, and most preferably from about 8% to about 30%, by weight of a mixture of particularly defined nonionic and cationic surfactants, and from about 0.01% to about 3%, preferably from about 0.05% to about 1.5%, most preferably from about 0.1% to about 0.5%, by weight of the selected anionic brighteners herein.

Preferred compositions contain at least about 8% of the nonionic/cationic surfactant mixture and at least about 1.5% of the cationic component in order to assure the presence of a sufficient amount of both the cationic surfactant and the nonionic/cationic mixture to provide the desired cleaning and fabric care benefits.

In addition, the weight ratio of nonionic to cationic surfactant should be from about 2:1 to about 40:1, preferably from about 2.5:1 to about 20:1, and more preferably from about 3:1 to about 12:1. Optimum removal of greasy/oily soils is generally obtained with nonionic:cationic surfactant weight ratios of from about 5:1 to about 20:1; while optimum removal of particulate soils is obtained with compositions having nonionic:cationic surfactant weight ratios of from about 2:1 to about 9:1, especially from about 3:1 to about 6.5:1, most especially from about 3.5:1 to about 5.5:1.

The equivalent weight (defined as the molecular weight of the molecule divided by its charge) ratio of the cationic surfactant to the brightener should also be greater than about 3, and preferably greater than about 6, for economical reasons and to minimize any green/yellow tinting of fabrics caused by excessive brightener levels.

The compositions of the present invention are preferably formulated so as to have a pH of at least about 6 in the laundry solution, at conventional usage concentrations, in order to optimize their overall cleaning performance, to aid in their manufacturing and processing and to minimize the possibility of washing machine corrosion. Alkalinity sources, such as potassium hydroxide, potassium carbonate, potassium bicarbonate, sodium hydroxide, sodium carbonate, and sodium bicarbonate, can be included in the compositions for this purpose. Some of the cationic/nonionic systems of the present invention attain optimum removal of greasy/oily soils at higher pHs, while attaining optimum particulate removal at relatively lower pHs. In these systems, overall performance can be enhanced by varying the pH of the wash solution during the laudering process. Compositions having a pH of at least about 8 in the laundry solution provide better removal of greasy/oily and body soils. Such compositions preferably also have the ability to maintain a pH in the laundry solution of from about 8 to 11, throughout the washing operation (reserve alkalinity), which can be obtained by incorporating compounds which buffer at pH's of from about 8 to 11, such as monoethanolamine (preferred), diethanolamine, and triethanolamine. However, the compositions herein preferably are formulated to provide a pH in the laundry solution of from about 6.5 to about 7.5.

Preferred compositions of the present invention are also essentially free of oily hydrocarbon materials and solvents, such as mineral oil, paraffin oil and kerosene, since these materials, which are themselves oily by nature, load the washing liquor with excessive oily material, thereby diminishing the cleaning effectiveness of the compositions themselves.

NONIONIC SURFACTANT

Nonionic surfactants useful herein are ethoxylated alcohols or ethoxylated alkyl phenols of the formula $R(OC_2H_4)_nOH$, wherein R is an aliphatic hydrocarbon radical containing from about 10 to about 18 carbon atoms or an alkyl phenyl radical in which the alkyl group contains from about 8 to about 15 carbon atoms, n is from about 2 to about 9 and the nonionic surfactant has an HLB (hydrophilic-lipophilic balance, as defined in *Nonionic Surfactants* by M. J. Schick, Marcel Dekker, Inc., 1966, pages 607–613, incorporated herein by reference) of from about 5 to about 14, preferably from about 6 to about 13. Examples of such surfactants are listed in U.S. Pat. No. 3,717,630, Booth, issued Feb. 20, 1973, and U.S. Pat. No. 3,332,880, Kessler et al, issued July 25, 1967, both incorporated herein by reference.

Nonionic surfactants useful herein include the condensation products of alkyl phenols having an alkyl group containing from about 8 to 15 carbon atoms in either a straight chain or branched chain configuration with ethylene oxide, said ethylene oxide being present in an amount equal to 2 to 9 moles of ethylene oxide per mole of alkyl phenol. The alkyl substituent in such compounds can be derived, for example, from polymerized propylene, diisobutylene, and the like. Examples of compounds of this type include nonyl phenol condensed with about 9 moles of ethylene oxide per mole of nonyl phenol; and dodecyl phenol condensed with about 8 moles of ethylene oxide per mole of phenol.

Other useful nonionic surfactants are the condensation products of aliphatic alcohols with from about 2 to about 9 moles of ethylene oxide. The alkyl chain of the aliphatic alcohol can either be straight or branched, primary or secondary, and should contain from about 10 to about 18 carbon atoms. Examples of such ethoxylated alcohols include the condensation product of myristyl alcohol condensed with about 9 moles of ethylene oxide per mole of alcohol; and the condensation product of about 7 moles of ethylene oxide with coconut alcohol (a mixture of fatty alcohols with alkyl chains varying in length from 10 to 14 carbon atoms). Examples of commercially available nonionic surfactants in this type Tergitol 15-S-9, marketed by Union Carbide Corporation, Neodol 45-9, Neodol 23-6.5, Neodol 45-7, and Neodol 45-4, marketed by Shell Chemical Company, and Kyro EOB, marketed by The Procter & Gamble Company.

Preferred nonionic surfactants because of their superior biodegradability are of the formula $R(OC_2H_4)_nOH$, wherein R is a primary alkyl chain containing an average of from about 10 to about 18, preferably from about 10 to about 16, carbon atoms, and n is an average of from about 2 to about 9, preferably from about 2 to about 7. These nonionic surfactants have an HLB (hydrophilic-lipophilic balance) of from about 5 to about 14, preferably from about 6 to about 13.

Examples of preferred nonionic surfactants include the condensation product of coconut alcohol with 5 moles of ethylene oxide; the condensation product of coconut alcohol with 6 moles of ethylene oxide; the condensation product of $C_{12-15}$ alcohol with 7 moles of ethylene oxide; the condensation product of $C_{12-15}$ alcohol with 9 moles of ethylene oxide; the condensation product of $C_{14-15}$ alcohol with 2.25 moles of ethylene oxide; the condensation product of $C_{14-15}$ alcohol with 7 moles of ethylene oxide; the condensation product of $C_{9-11}$ alcohol with 8 moles of ethylene oxide, which is stripped so as to remove unethoxylated and lower ethoxylate fractions; the condensation product of $C_{12-13}$ alcohol with 6.5 moles of ethylene oxide, and this same alcohol ethoxylate which is stripped so as to remove unethoxylated and lower ethoxylate fractions. A preferred class of such surfactants utilize alcohols which contain about 20% 2-methyl branched isomers, and are commercially available, under the tradename Neodol, from Shell Chemical Company. The condensation product of tallow alcohol with 9 moles of ethylene oxide is also a preferred nonionic surfactant for use herein. Particularly preferred nonionic surfactants for use in the compositions of the present invention include the condensation product of coconut alcohol with 5 moles of ethylene oxide, the condensation product of $C_{12-13}$ alcohol with 6.5 moles of ethylene oxide, the condensation product of $C_{12-15}$ alcohol with 7 moles of ethylene oxide, the condensation product of $C_{14-15}$ alcohol with 7 moles of ethylene oxide, and the same material stripped of unethoxylated alcohol and lower ethoxylated fractions, and mixtures thereof.

Preferred compositions of the present invention are substantially free of fatty acid polyglycol ether di-ester compounds, such as polyethylene glycol-600-dioleate or polyethylene glycol-800-distearate. Such additives can be detrimental to the particulate soil removal and fabric conditioning benefits provided by the present compositions.

CATIONIC SURFACTANT

The cationic surfactants used in the compositions of the present invention are of the di-long chain quaternary ammonium type, having two chains which contain an average of from about 12 to about 22, preferably from about 16 to about 22, more preferably from about 16 to about 18, carbon atoms. The remaining groups, if any, attached to the quaternary nitrogen atom are preferably $C_1$ to $C_4$ alkyl or hydroxyalkyl groups. Although it is preferred that the long chains be alkyl groups, these chains can contain hydroxy groups or can contain heteroatoms or other linkages, such as double or triple carbon-carbon bonds, and ester, amide, or ether linkages, as long as each chain falls within the above carbon atom ranges. Preferred cationic surfactants are those having the formula

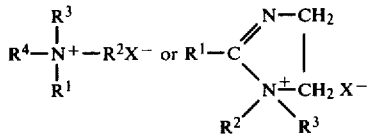

wherein the $R^1$ and $R^2$ groups contain an average of from about 16 to about 22 carbon atoms, preferably as alkyl groups, and most preferably contain an average of from about 16 to about 18 carbon atoms, $R^3$ and $R^4$ are $C_1$ to $C_4$ alkyl or hydroxyalkyl groups, and X is any compatible anion, particularly one selected from the group consisting of halide (e.g., chloride, bromide), hydroxide, methylsulfate, or acetate.

Mixtures of the above surfactants are also useful in the present invention. These cationic surfactants can also be mixed with other types of cationic surfactants, such as sulfonium, phosphonium, and mono- or tri-long chain quaternary ammonium materials, as long as the amount of required cationic surfactant falls within the nonionic:cationic ratios herein. Examples of cationic surfactants which can be used in combination with those required herein are described in U.S. Pat. No. 4,259,217, Murphy, U.S. Pat. No. 4,222,905, Cockrell, U.S. Pat. No. 4,260,529, Letton, and U.S. Pat. No. 4,228,042, Letton, all incorporated herein by reference.

Preferred cationic surfactants include ditallowalkyldimethyl (or diethyl or dihydroxyethyl) ammonium chloride, ditallowalkyldimethylammonium methyl sulfate, dihexadecylalkyl ($C_{16}$) dimethyl (or diethyl, or dihydroxyethyl) ammonium chloride, dioctodecylalkyl ($C_{18}$)dimethylammonium chloride, dieicosylalkyl($C_{20}$) dimethylammonium chloride, methyl (1) tallowalkyl amido ethyl (2) tallowalkyl imidazolinium methyl sulfate (commercially available as Varisoft 475 from Ashland Chemical Company), or mixtures of those surfactants. Particularly preferred cationic surfactants are ditallowalkyldimethylammonium methyl sulfate, methyl (1) tallowalkyl amido ethyl (2) tallowalkyl imidazolinium methyl sulfate, and mixtures of those surfactants, with ditallowalkyldimethylammonium chloride being especially preferred.

The compositions of the present invention can be formulated so as to be substantially free of ethoxylated cationic surfactants which contain more than an average of about 10, and preferably free of those which contain more than an average of about 7, moles of ethylene oxide per mole of surfactant. It is to be noted that polyethoxylated cationic surfactants having relatively low levels of ethoxylation, i.e., those with less than 10, and particularly less than 7, ethylene oxide groups exhibit better biodegradability characteristics.

ANIONIC BRIGHTENER

The anionic brighteners of the present invention are of the formula

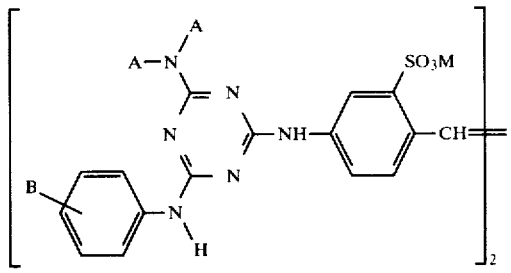

wherein each A is hydrogen, methyl, ethyl, isopropyl, 2-hydroxyethyl, 2-hydroxypropyl, or propanamido, or taken together are morpholino or anilino; and each B is hydrogen or —$SO_3M$, wherein M is a compatible cation and the total number of —$SO_3M$ groups in the molecule is from 3 to 6 with no more than 2 —$SO_3M$ groups per anilino group.

Preferred brighteners contain from 3 to 5, and especially 4, —$SO_3M$ groups. While M can be any suitable cation, such as potassium, ammonium, or substituted ammonium (e.g., mono-, di-, or triethanolammonium), it preferably is sodium.

Preferred brighteners are those in which A in the above formula is 2-hydroxyethyl or 2-hydroxypropyl, or taken together form a morpholino group with the nitrogen atom.

Examples of brighteners of the above class are tetrasodium 4,4'-bis{{4-[bis(2-hydroxyethyl)amino]-6-(p-sulfoanilino)-1,3,5-triazin-2-yl}amino}-2,2'-stilbene disulfonate, commercially available as Tinopal DCS (powder) from Ciba-Geigy, and as Phorwhite BBU, (powder and liquid) from Mobay; and the corresponding material in which the 2-hydroxyethyl groups are replaced with 2-hydroxypropyl groups, commercially available as Phorwhite BRU from Mobay.

OPTIONAL COMPONENTS

In one embodiment of the present invention, the detergent compositions additionally contain from about 1% to about 25%, preferably from about 2% to about 16%, and most preferably from about 2% to about 10% of a fatty amide surfactant, such as ammonia amides (e.g., coconut ammonia amides), diethanol amides, and ethoxylated amides. In relation to the nonionic/cationic surfactant system, the weight ratio of the cationic/nonionic mixture to the amide component in the composition is in the range of from about 5:1 to about 50:1, preferably from about 8:1 to about 25:1. The use of amides in such compositions is described in greater detail in U.S. Pat. No. 4,228,044, Cambre, issued Oct. 14, 1980, incorporated herein by reference. These amide components can also be added in small amounts, i.e., from about 2% to about 5%, to act as suds modifiers. Specifically, it is believed that they tend to boost the sudsing in an active system which exhibits relatively low sudsing, and depress the sudsing in an active system which exhibits relatively high sudsing.

The compositions of the present invention can also contain additional ingredients generally found in laundry detergent compositions, at their conventional art-established levels, as long as these ingredients are compatible with the nonionic and cationic components required herein. For example, the compositions can contain up to about 15%, preferably up to about 5%, and most preferably from about 0.001% to about 2%, of a suds suppressor component. Typical suds suppressors useful in the compositions of the present invention include, but are not limited to, silicone-type suds suppressing additives which are described in U.S. Pat. No. 3,933,672, issued Jan. 20, 1976, Bartolotta et al, incorporated herein by reference and the self-emulsifying silicone suds suppressors, described in U.S. Pat. No. 4,075,118, Gault et al, issued Feb. 21, 1978, incorporated herein by reference. An example of such a compound is DB-544, commercially available from Dow Corning, which contains a siloxane/glycol copolymer together with solid silica and a siloxane resin.

Microcrystalline waxes having a melting point in the range from 35° C.–115° C. and a saponification value of less than 100 represent additional examples of a preferred suds regulating component for use in the subject compositions, and are described in detail in U.S. Pat. No. 4,056,481, Tate, issued Nov. 1, 1977, incorporated herein by reference.

Alkyl phosphate esters represent an additional preferred suds suppressant for use herein. These preferred phosphate esters are predominantly monostearyl phosphate which, in addition thereto, can contain di- and tristearyl phosphates and monooleyl phosphates, which can contain di- and trioleyl phosphates.

Other adjunct components which can be included in the compositions of the present invention, in their conventional art-established levels for use (i.e., from about 0% to about 40%, preferably from about 0% to about 20%, by weight), include semi-polar nonionic (such as trialkyl amine oxides), zwitterionic and ampholytic detergency cosurfactants; detergency builders; bleaching agents; bleach activators; soil release agents; soil suspending agents; corrosion inhibitors; dyes; fillers; optical brighteners; germicides; pH adjusting agents; alkalinity sources; hydrotropes; enzymes; enzyme-stabilizing agents; perfumes; solvents; carriers; suds modifiers; opacifiers; and the like. However, because of the numerous and diverse performance advantages of the present invention, conventional components such as detergent cosurfactants and detergency builders, as well as fabric softening and static control agents, will not generally be necessary in a particular formulation, giving the compositions of the present invention a potential cost advantage over other detergent/softener compositions. For environmental reasons the compositions of the present invention preferably contain less than about 15% phosphate materials. Preferred compositions contain less than 7% phosphate, and can even be substantially, or totally free of such phosphate materials, without excessively decreasing the performance of the compositions. The compositions of the present invention preferably contain less than 10%, and are preferably substantially free of silicate materials. Preferred compositions of the present invention are also substantially free of carboxymethylcellulose. Finally, while the compositions of the present invention can contain very small amounts of anionic materials, such as hydrotropes (e.g., alkali metal toluene sulfonates), it is preferred that particular anionic materials be contained in amounts sufficiently small such that not more than about 10%, preferably not more than about 1%, of the cationic surfactant contained in the laundry solution is complexed by the anionic material. Such complexing of the anionic material with the cationic surfactant decreases the overall cleaning and fabric conditioning performance of the compositions herein. Suitable anionic materials can be selected based on their strength of complexation with the cationic material included in the composition (as indicated by their dissociation constant). Thus, when an anionic material has a dissociation constant of at least about $1\times10^{-3}$ (such as sodium toluene sulfonate), it can be contained in an amount up to about 40% by weight of the cationic surfactant; and where the anionic material has a dissociation constant of at least about $1\times10^{-5}$, but less than about $1\times10^{-3}$, it can be contained in an amount up to about 15% by weight of the cationic surfactant. Preferred compositions are substantially free of such anionic materials.

Examples of cosurfactants and detergency builders which can be used in the compositions of the present invention are found in U.S. Pat. No. 3,717,630, Booth, issued Feb. 20, 1973, and U.S. Pat. No. 4,259,217, Murphy, issued Mar. 31, 1981, both of which are incorporated herein by reference. However, these components, particularly the anionic surfactants, should be checked with the particular nonionic/cationic surfactant system chosen and used in amounts that will be compatible with the nonionic/cationic surfactant system.

Highly preferred cosurfactants for use in the present compositions are alkylpolysaccharides having a hydrophobic group containing from about 6 to about 30 carbon atoms, preferably from about 10 to about 16 carbon atoms and a polysaccharide, e.g., a polyglycoside, hydrophilic group containing from about 1½ to about 10, preferably from about 1½ to about 3, most preferably from about 1.6 to about 2.7 saccharide units. Any reducing saccharide containing 5 or 6 carbon atoms can be used, e.g. glucose, galactose and galactosyl moieties can substitute for the glucosyl moieties. (Optionally the hydrophobic group is attached at the 2, 3, 4 etc. positions thus giving a glucose or galactose as opposed to a glucoside or galactoside.) The intersaccharide bonds can be, e.g., between the one position of the additional saccharide units and the 2-, 3-, 4-, and/or 6 positions on the preceding saccharide units.

Optionally, and less desirably, there can be a polyalkoxide chain joining the hydrophobic moiety and the polysaccharide moiety. The preferred alkoxide is ethylene oxide. Typical hydrophobic groups include alkyl groups, either saturated or unsaturated, branched or unbranched containing from about 8 to about 18, preferably from about 10 to about 16 carbon atoms. Preferably, the alkyl group is a straight chain saturated alkyl group. The alkyl group can contain up to 3 hydroxy groups and/or the polyalkoxide chain can contain up to about 10, preferably less than 5, most preferably 0, alkoxide moieties. Suitable alkyl polysaccharides are octyl, nonyl, decyl, undecyl, dodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses, and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof, in which said alkyl groups contain from about 10 to about 18, preferably from about 12 to about 14, carbon atoms; n is 2 or 3, preferably 2; t is from 0 to about 10, preferably 0; and x is from 1½ to about 10, preferably from about 1½ to about 3, most preferably from about 1.6 to about 2.7. The glycosyl is preferably derived from glucose. To prepare compounds, the alcohol or alkylpolyethoxy alcohol is formed first and then reacted with glucose, or a source of glucose, to form the glucoside (attachment at the 1-position). The additional glycosyl units are attached between their 1-position and the preceding glycosyl units 2-, 3-, 4- and/or 6-position, preferably predominately the 2-position.

Preferably the content of alkylmonoglycoside is low, preferably less than about 60%, more preferably less than about 50%.

It is believed that the above polysaccharide surfactants enhance brightener effectiveness in the present compositions by helping to solubilize the brighteners and/or brightener/cationic complexes, and by minimizing the interference of the nonionic surfactants herein with brightener deposition and fluorescence at fabric surfaces.

Another highly preferred material for use in liquid compositions herein containing the above polysaccharide surfactants is a polyethylene glycol having an average molecular weight of from about 2000 to about 15,000, preferably from about 3000 to about 10,000, and more preferably from about 4000 to about 8000. The polyethylene glycol enhances cleaning, and especially particulate soil removal, when added to such compositions. Stable liquid compositions can be formulated containing from about 0.1% to about 10%, preferably from about 0.5% to about 5%, and more preferably from about 0.8% to about 3%, by weight of polyethylene glycol. Such compositions containing more than about 2% by weight of polyethylene glycol should contain a suitable hydrotrope to aid solubilization. A preferred hydrotrope is butyl glycoside, and it should represent from about 2% to about 10% by weight of the polysaccharide surfactant.

The compositions of the present invention can be produced in a variety of forms, including liquid, solid, granular, paste, powder or substrate compositions. In a particularly preferred embodiment, the compositions of the present invention are formulated as liquids and contain up to about 20% of a lower alkyl ($C_1$ to $C_4$) alcohol, particularly ethanol. Liquid compositions containing lower levels of such alcohols (i.e., less than 12%) are preferred because they tend to exhibit less phase separation than compositions containing higher alcohol levels.

The compositions of the present invention are used in the laundering process by forming an aqueous solution containing from about 0.01% (100 parts per million) to about 0.3% (3,000 parts per million), preferably from about 0.02% to about 0.25%, and most preferably from about 0.03% to about 0.2%, of the nonionic/cationic detergent mixture, and agitating the soiled fabrics in that solution. The fabrics are then rinsed and dried. When used in this manner, the compositions of the present invention yield exceptionally good particulate soil removal, and also provide fabric softening, static control, color fidelity, and dye transfer inhibition to the laundered fabrics, without requiring the use of any of the other conventionally-used fabric softening and/or static control laundry additives. The compositions also provide important whiteness maintenance benefits on cotton fabrics.

All percentages, parts, and ratios used herein are by weight unless otherwise specified.

The following nonlimiting examples illustrate the compositions and the method of the present invention.

EXAMPLE I

Heavy-duty liquid detergent compositions of the present invention are as follows.

| | % by weight | | | | | |
|---|---|---|---|---|---|---|
| Component | A | B | C | D | E | F |
| Ditallow dimethyl ammonium chloride | 3.6 | 4.8 | 2.0 | 2.7 | 2.7 | 2.5 |
| $C_{12-16}$ alkyl dimethyl amine oxide | 4.0 | — | 4.0 | 2.0 | — | — |
| $C_{12-13}$ alkylpolyglycoside (~2)[1] | — | — | — | 12.0 | 12.0 | 9.0 |
| $C_{14-15}$ alkylpolyethoxylate (7)[2] | 18.0 | 11.0 | 15.0 | 8.0 | 10.0 | 9.0 |
| $C_{12-13}$ alkylpolyethoxylate (6.5) | 12.0 | — | — | — | — | |
| Ethanol | 7.5 | 15.0 | 7.5 | 5.8 | 5.8 | 7.5 |
| PEG 6000[3] | — | — | 1.0 | — | 1.0 | 1.0 |
| Brightener[4] | 0.2 | 0.2 | 0.4 | 0.2 | 0.2 | 0.3 |
| $N_a$ citrate | 0.7 | 0.7 | 5.0 | 0.7 | 0.7 | 5.0 |
| $H_2O$ + minors | Balance to 100 | | | | | |

[1]The glycoside units are derived from glucose.
[2]The alcohol and monoethoxylated alcohol have been removed.
[3]Polyethylene glycol of molecular weight 6000.
[4]Tetrasodium 4,4'-bis{{4-[bis(2-hydroxyethyl)amino]-6-(p-sulfoanilino)-1,3,5-triazin-2-yl}amino}-2,2'-stilbene disulfonate.

Other compositions of the present invention are obtained when the cationic surfactant in the above compositions is replaced, in whole or in part, by ditallowalkyldimethylammonium methyl sulfate, ditallowalkyldimethylammonium iodide, dihexadecylalkyldimethylammonium chloride, dihexadecylalkyldihydroxyethylammonium methyl sulfate, dioctadecylalkyldimethylammonium chloride, dieicosylalkyl methyl ethyl ammonium chloride, dieicosylalkyl dimethylammonium bromide, methyl (1) tallowalkyl amido ethyl (2) tallowalkyl imidazolinium methyl sulfate, or mixtures of these surfactants.

Other compositions herein are also obtained where the nonionic surfactant in the above compositions is replaced, in whole or in part, by the condensation product of $C_{14-15}$ alcohol with 2.25 moles of ethylene oxide; the condensation product of $C_{14-15}$ alcohol with 7 moles of ethylene oxide; the condensation product of $C_{12-15}$ alcohol with 9 moles of ethylene oxide; the condensation product of $C_{12-13}$ alcohol with 6.5 moles of ethylene oxide, which is stripped so as to remove lower ethoxylate and nonethoxylated fractions; the condensation product of coconut alcohol with 5 moles of ethylene oxide; the condensation product of coconut alcohol with 6 moles of ethylene oxide; the condensation product of $C_{12-15}$ alcohol with 7 moles of ethylene oxide; the condensation product of tallow alcohol with 9 moles of ethylene oxide; a 1:1 by weight mixture of the condensation product of $C_{12-15}$ alcohol with 7 moles of ethylene oxide and the condensation product of $C_{14-15}$ alcohol with 7 moles of ethylene oxide; and other mixtures of those surfactants.

Compositions of the present invention are also obtained when, in the above brightener, the 2-hydroxyethyl groups are replaced with 2-hydroxypropyl groups, or together form a morpholine group with the nitrogen atom. Other compositions herein are obtained when the above brighteners are replaced with the corresponding pentasulfonated or hexasulfonated brighteners.

The above compositions can also contain a suds suppressor such as trimethyl-, diethyl-, dipropyl-, dibutyl-, methylethyl-, or phenylmethyl polysiloxane, or mixtures thereof; a petrolatum or oxidized petrolatum wax; a Fischer-Tropsch or oxidized Fischer-Tropsch wax; ozokerite; ceresin; montan wax; beeswax; candelilla; or carnauba wax.

What is claimed is:

1. A stable aqueous liquid laundry detergent composition comprising:

(a) from about 5% to about 95% by weight of a surfactant mixture consisting essentially of:

(i) an ethoxylated alcohol or ethoxylated alkyl phenol nonionic surfactant of the formula $R(OC_2H_4)_nOH$, wherein R is an aliphatic hydrocarbon radical containing from about 10 to about 18 carbon atoms or an alkyl pheny radical in which the alkyl group contains from about 8 to about 15 carbon atoms, and n is from about 2 to about 9, said nonionic surfactant having an HLB of from about 5 to about 14; and (ii) a quaternary ammonium cationic surfactant having 2 chains which each contain an average of from about 12 to about 22 carbon atoms;

the weight ratio of said nonionic surfactant to said cationic surfactant being from about 2:1 to about 40:1; and (b) from about 0.01% to about 3% by weight of an anionic brightener of the formula

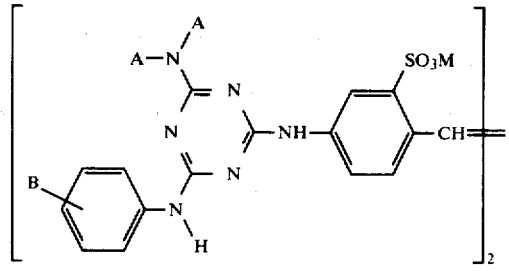

wherein each A is hydrogen, methyl, ethyl, isopropyl, 2-hydroxyethyl, 2-hydroxypropyl, or propanamido, or taken together are morpholino or anilino; and each B is hydrogen or $—SO_3M$, wherein M is a compatible cation and the total number of $—SO_3M$ groups in the molecule is from 3 to 6 with no more than 2 $—SO_3M$ groups per anilino group;

the equivalent weight ratio of said cationic surfactant to said brightener being greater than about 3.

2. The composition of claim 1 wherein the nonionic surfactant is an ethoxylated alcohol in which R is an alkyl group containing from about 10 to about 16 carbon atoms and n is from about 2 to about 7.

3. The composition of claim 2 wherein the cationic surfactant has 2 chains which each contain an average of from about 16 to about 18 carbon atoms.

4. The composition of claim 3 wherein the weight ratio of nonionic surfactant to cationic surfactant is from about 3:1 to about 12:1.

5. The composition of claim 1 wherein the total number of $—SO_3M$ groups in the brightener is 4.

6. The composition of claim 5 wherein A in the brightener is 2-hydroxyethyl or 2-hydroxypropyl, or taken together form a morpholino group with the nitrogen atom.

7. The composition of claim 4 wherein the total number of $—SO_3M$ groups in the brightener is 4 and A is 2-hydroxyethyl or 2-hydroxypropyl, or taken together form a morpholino group with the nitrogen atom.

8. The composition of claim 7 comprising from about 8% to about 30% by weight of the nonionic and cationic surfactants and from about 0.1% to about 0.5% by weight of the brightener.

9. The composition of claim 8 additionally comprising an alkylpolysaccharide detergent surfactant of the formula $RO(R'O)_y(Z)_x$ where R is an alkyl, hydroxyalkyl, alkylphenyl, hydroxyalkylphenyl, alkylbenzyl, or mixtures thereof, said alkyl groups containing from about 8 to about 18 carbon atoms; where each R' contains from 2 to about 4 carbon atoms and y is from 0 to about 12; and where each Z is a moiety derived from a reducing saccharide containing 5 or 6 carbon atoms; and x is a number from about 1½ to about 10; wherein the weight ratio of nonionic surfactant to alkylpolysaccharide surfactant is from about 1:3 to about 3:1, and the weight ratio of nonionic and polysaccharide surfactants to cationic surfactant is from about 2:1 to about 12:1.

10. The composition of claim 9 wherein the alkylpolysaccharide surfactant is of the formula $R^2O(C_nH_{2n}O)_t(\text{glycosyl})_x$, wherein $R^2$ is selected from the group consisting of alkyl, alkylphenyl, hydroxyalkyl, hydroxyalkylphenyl, and mixtures thereof, in which said alkyl groups contain from about 10 to about 18 carbon atoms, n is 2 or 3, t is from 0 to about 10, the glycosyl moiety is derived from glucose, and x is from about 1½ to about 3.

* * * * *